US009572225B2

(12) United States Patent
Wuppinger et al.

(10) Patent No.: US 9,572,225 B2
(45) Date of Patent: Feb. 14, 2017

(54) METHOD AND DEVICE FOR DETERMINING LIFE EXPECTANCY INFORMATION OF AN LED MODULE

(71) Applicant: Siteco Beleuchtungstechnik GmbH, Traunreut (DE)

(72) Inventors: Bernhard Wuppinger, Surberg (DE); Markus Rhein, Waging (DE); Julia Pölzl, Grabenstaett (DE)

(73) Assignee: SITECO BELEUCHTUNGSTECHNIK GMBH, Traunreut (DE)

( * ) Notice: Subject to any disclaimer, the term of this patent is extended or adjusted under 35 U.S.C. 154(b) by 0 days.

(21) Appl. No.: 15/099,722

(22) Filed: Apr. 15, 2016

(65) Prior Publication Data

US 2016/0309562 A1 Oct. 20, 2016

(30) Foreign Application Priority Data

Apr. 17, 2015 (DE) ..... 10 2015 105 914

(51) Int. Cl.
*H05B 41/24* (2006.01)
*H05B 33/08* (2006.01)

(52) U.S. Cl.
CPC ..... *H05B 33/0893* (2013.01)

(58) Field of Classification Search
CPC . H05B 41/2928; H05B 41/392; B23K 11/248; Y02B 20/208; H02M 1/042
USPC ..... 315/287, 192, 193, 307
See application file for complete search history.

(56) References Cited

U.S. PATENT DOCUMENTS

2010/0225235 A1 9/2010 Nagase
2011/0089855 A1 4/2011 Roberts et al.
2012/0290241 A1 11/2012 Nguyen et al.
2014/0074434 A1 3/2014 De Lima et al.
2014/0225508 A1* 8/2014 Pauritsch ..... H05B 33/0887 315/122
2015/0084637 A1 3/2015 Boehnel

FOREIGN PATENT DOCUMENTS

DE 102012206891 A1 10/2013

OTHER PUBLICATIONS

German Search Report based on application No. 10 2015 105 914.2 (1 page) (for reference purpose only).

* cited by examiner

*Primary Examiner* — Minh D A
(74) *Attorney, Agent, or Firm* — Viering, Jentschura & Partner mbB

(57) ABSTRACT

Various embodiments may relate to a method for determining life expectancy information of an LED module with a plurality of LEDs. The method includes detecting of forward biases of the LED module at instants of time which lie less than 100 ms apart from each other, comparing a currently detected forward bias with one or more earlier detected forward biases, in order to detect a voltage jump which reaches a minimum initial inverse voltage within a predetermined jump duration, wherein the minimum initial inverse voltage is at least 60 mV and the predetermined jump duration is less than 100 ms long, and determining life expectancy information based on one or more detected voltage jumps.

12 Claims, 4 Drawing Sheets

METHOD AND DEVICE FOR DETERMINING LIFE EXPECTANCY INFORMATION OF AN LED MODULE

CROSS-REFERENCE TO RELATED APPLICATION

This application claims priority to German Patent Application Serial No. 10 2015 105 914.2, which was filed Apr. 17, 2015, and is incorporated herein by reference in its entirety.

TECHNICAL FIELD

Various embodiments generally relate to a method and a device for determining life expectancy information of an LED module with a plurality of LEDs.

BACKGROUND

LEDs typically have a higher life expectancy than conventional illuminants such as e.g. light bulbs or compact fluorescent lights. Nevertheless, there is also a need in LED modules to detect an impending failure of the LED module. In particular, it is important to detect an impending failure of the LED module which is not due to a failure of one of the LEDs, but rather to another ageing phenomenon of the LED module. These other ageing phenomena lead typically distinctly more frequently and sooner to a failure of the LED module than the ageing of the LEDs themselves.

From the related art, it is known that individual operating parameters of illuminants, e.g. the voltage applied in constant current operation, gradually change with increasing age of the illuminant and therefore a residual life expectancy of the illuminant can be estimated.

SUMMARY

Various embodiments provide a device and a method which enables a reliable determining of life expectancy information of an LED module.

The problem is solved according to the present disclosure by a method for determining life expectancy information of an LED module with a plurality of LEDs, wherein the method includes the steps:

detecting of forward biases of the LED module at instants of time which lie less than 100 ms apart from each other, comparing a currently detected forward bias with one or more earlier detected forward biases, in order to detect a voltage jump which reaches a minimum initial inverse voltage within a predetermined jump duration, wherein the minimum initial inverse voltage is at least 60 mV and the predetermined jump duration is less than 100 ms long, and determining life expectancy information based on one or more detected voltage jumps.

The inventors have discerned that the particular thermal conditions within LED modules are critical for a premature failure of the LED modules. Relative to the generated lighting current, LEDs indeed heat up distinctly less than e.g. light bulbs. Owing to the small size of the LEDs, however, nevertheless a high heat development occurs at the site of the LEDs and at the site of the soldering points by which the LEDs are electrically connected with the LED module and are fastened mechanically to the LED module. In particular in the case of frequent switching on and off of the LED module, therefore high temperature fluctuations occur at the site of the soldering points.

These temperature fluctuations represent a high thermal and mechanical load for the soldering points and lead to thermal distortions, which can ultimately lead to the failure of the LED module. In particular, the thermal distortions can lead to the occurrence of cracks in the soldering points. These cracks can suddenly arise and in so doing cause a suddenly changed voltage drop at the soldering point. The fatigue of a soldering point which is subjected to thermal alternating load can take place through crack initiation at the outer edges of the soldering point and further damage through crack propagation, until these ultimately break. The progress of the soldering point fatigue can be established by means of the voltage jumps. By permanent (or respectively periodic) monitoring of the forward bias of one or more LEDs, it is therefore possible to detect premature failures of the LED module.

According to various embodiments, these suddenly increased voltage drops can be detected and used to predict life expectancy information.

The detection of the forward biases can follow e.g. through an A/D converter, wherein the forward biases detected by the A/D converter are stored in a storage array of a microcontroller.

The instants of time at which the detection takes place can lie at regular intervals from one another. For example, a D/A converter can read in forward biases with a fixed clock rate.

The forward bias can be tapped at the positive and negative connection of the LED module. The LED module can be constructed to be supplied from a constant current source. This is the case in particular when the LED module does not have its own control electronics.

In various embodiments, the LED module includes a plurality of LEDs connected in series. In particular embodiments, the forward bias can also be tapped here directly at the positive and negative connections of this series connection.

In various embodiments, provision is made that the LEDs of the LED module are supplied from a constant current source.

The LEDs of the LED module can be soldered on a printed circuit board. Alternatively, however, other arrangements are also conceivable. A soft solder or a hard solder can come into use here as solder. In particular, tin solders come into use. These can have different proportions of tin and lead with small proportions of iron, antimony, copper and nickel.

According to various embodiments, provision is made that the minimum initial inverse voltage is more than 200 m V, in particular more than 500 m V and/or the jump duration is less than 50 ms, in particular less than 10 ms long.

Therefore, voltage jumps due to fatigue can be differentiated from pure noise in the detection of the forward bias.

In particular, provision can be made that the minimum initial inverse voltage is more than 1 V or more than 2 V and/or the jump duration is less than 5 ms or less than 2 ms.

The detection also of such short voltage jumps presupposes if applicable that the forward bias is detected in correspondingly short time intervals.

In various embodiments, provision is made that for negative voltage jumps, in which the forward bias jumps to a lower value, a negative minimum initial inverse voltage is defined, and for positive voltage jumps, in which the forward bias jumps to a higher value, a positive minimum initial inverse voltage is defined, wherein the positive minimum initial inverse voltage is different from the negative minimum initial inverse voltage.

Preferably both positive and negative voltage fluctuations are detected as voltage jumps. However, experiments have shown that with particular LED modules positive voltage jumps, in which the forward bias at the LED module increases suddenly, are an even more reliable sign of an impending failure than negative voltage jumps. In this respect, it can be advantageous to select a positive minimum initial inverse voltage, which is established to be lower than the negative minimum initial inverse voltage. Therefore, more positive voltage jumps can be detected and taken into consideration in the determining of life expectancy information.

In further embodiments, provision can also be made that the minimum initial inverse voltage, starting from which a voltage jump is detected, is determined relative to the forward bias. For example, the minimum initial inverse voltage can be 0.05% of the forward bias. In further embodiments of the invention, the minimum initial inverse voltage can be 0.1%, 0.3%, 1% or 3% of the forward bias. Here, the minimum initial inverse voltage can be determined relative to the instantaneous forward bias or relative to the time-averaged forward bias.

The minimum initial inverse voltage, starting from which a voltage jump is detected, is an error criterion which, like other error criteria, can be defined according to application (ambient temperature ranges, LED, printed circuit board material, . . . ). Preferably, minimum initial inverse voltages are defined between 0.3-2.0 V.

According to various embodiments, provision is made that the life expectancy information includes:

a first alarm information, which is emitted when a voltage jump is detected for the first time, and/or a second alarm information, which is emitted when within a predetermined period of time more than one predetermined number of voltage jumps is detected.

The first alarm information can therefore relate to a first early warning. Typically, a first voltage jump will already occur relative early in the life cycle of an LED module, e.g. at a moment in time at which the likelihood of failure is still below 10%.

In so far as the minimum initial inverse voltage, starting from which a voltage jump is detected, is established somewhat higher, e.g. at at least 500 m V, at least 1 V or at least 3 V, a first such voltage jump can, however, also already indicate that a likelihood of a failure soon has already reached 50%.

The second alarm information relates to the fact that within a predetermined period of time more than a predetermined number of voltage jumps is detected, i.e. that already a certain frequency of voltage jumps is reached. The predetermined period of time relates here typically only to an active period of time of the LED module.

Compared with the first alarm information, the second alarm information is typically an even more reliable indication for an ageing of the LED module or respectively of soldering points of the LED module, so that a failure of the LED module soon is to be suspected.

According to an embodiment of the invention, provision is made that the emitting of the first and/or second alarm information includes emitting an acoustic and/or visual warning signal, in particular setting the LED module into a blinking mode.

Therefore, it can be indicated to a user at an early stage that a failure of the LED module is impending.

It shall be understood that in various embodiments a warning signal can also be emitted in the case of different alarm information from the above-mentioned first and/or second alarm information. For example, a warning signal can be emitted when a practically calculated remaining life expectancy of the LED module is less than a predetermined minimum life expectancy.

In various embodiments, the emitting of a warning signal can also take place directly after the detection of voltage jumps. Therefore, a user can be informed of an impending failure immediately without chronological delay. This has the further advantage that the user can possibly detect that the ageing of the LED module is possibly due to a particular operating mode.

For example, when the LED module is installed in a lampshade in which heat cannot be dissipated sufficiently, it is expedient that the user is informed immediately via the voltage jumps.

In various embodiments, provision can also be made that with the emitting of the first and/or second alarm information a marker is set that with the next switching on of the LED module a warning signal is emitted. Therefore, the next time the LED module is switched on, the user can be informed of the impending failure.

According to various embodiments, provision is made that the method furthermore includes:

detecting a temperature and adapting the minimum initial inverse voltage and/or the predetermined jump duration based on the detected temperature.

According to various embodiments, provision is made that after a switching on of the LED module, firstly a predetermined settling time is awaited, before the further method steps are carried out. Therefore, it can be prevented that voltage fluctuations, which are due to a normal settling behaviour after switching on, are misleadingly identified as voltage jumps due to ageing and therefore falsify the determining of the life expectancy information.

According to various embodiments, the determining of the life expectancy information can also take place as a function of the detected temperature. For example, it can be taken into consideration that with a higher temperature of the LED module generally a shorter life expectancy is to be assumed.

Typically, voltage jumps due to ageing first occur at a certain heating of the LED modules. As some time elapses after switching on before this heating is reached, the predetermined settling time can be selected generously. For example, the predetermined settling time which is waited can be 1 second, 5 seconds or 30 seconds.

According to various embodiments, provision is made that the method furthermore includes the steps:

storing of detected forward biases in a storage array, determining a minimum and/or a maximum forward bias stored in the storage array, wherein the comparing of a currently detected forward bias with one or more earlier detected forward biases includes comparing the currently detected forward bias with the minimum and/or with the maximum forward bias.

Therefore, a method is provided which is particularly simple to implement, in which individual outliers can be reliably identified as voltage jumps.

According to various embodiments, provision is made that more than 20 and/or fewer than 200 forward biases are stored in the storage array. In various embodiments, provision can also be made that only 10 forward biases are stored or more than 500 forward biases are stored.

In various embodiments, provision can be made that only a particular subset of the detected forward biases are stored in the storage array. For example, every other or every third detected forward bias can be stored in the storage array.

According to various embodiments, provision is made that the method furthermore includes a step of averaging several detected forward biases, in order to obtain a time-averaged forward bias, wherein the comparing of a currently detected forward bias with one or more earlier detected forward biases includes comparing the currently detected forward bias with the time-averaged forward bias.

Comparing the currently detected forward biases with a time-averaged forward bias has the effect that individual small outliers in the detection of the forward bias are not used for the comparison with the currently detected forward bias. As these smaller outliers are typically due to noise in the detection of the forward bias, it can be expedient not to take them into consideration in the determining of the voltage jumps.

The determining of the time-averaged forward bias can take place over a predetermined time, which can be e.g. 0.1 seconds, 1 second, 10 seconds or 1 minute.

According to various embodiment, provision is made that the life expectancy information includes a likelihood of failure, wherein the likelihood of failure is determined based on an extent and/or a frequency of the voltage jumps, wherein the likelihood of failure is in particular determined proportional to the extent and/or to the frequency of the voltage jumps. For example, the calculation can take place via a formula in which both an average initial inverse voltage of the last detected initial inverse voltages and also the frequency and/or cumulative frequency of the initial inverse voltages appear as factors.

Therefore, it is particularly simple to determine an estimated value for the likelihood of failure. It shall be understood that according to various embodiments the particular likelihood of failure does not inevitably have to be determined exactly proportional to the extent and/or the frequency of the voltage jumps. It is also conceivable that the likelihood of failure is determined via a formula in which a proportionality to the extent and/or to the frequency of the voltage jumps exists only in particular sections.

According to various embodiments, provision is made that the method furthermore includes a step to determine a difference of the detected forward bias from a reference forward bias, wherein the likelihood of failure is determined proportional to the difference. In this embodiment, the determining of the likelihood of failure can therefore be proportional to the said difference and the extent and/or the frequency of the voltage jumps.

The problem named in the introduction is also solved according to various embodiments by a device which is constructed to carry out the method according to one of the above-mentioned embodiments.

According to various embodiments, provision is made that the device furthermore has a bus interface and/or a wireless interface, which is constructed to emit the life expectancy information. Therefore, the information concerning the life expectancy of different LED modules can be detected centrally in a building. Therefore, an overview can be easily obtained as to where and when which LED modules must likely be replaced.

The wireless interface can be a WLAN module, which is constructed to receive a wireless connection with a WLAN and with the internet. The wireless interface can also be a wireless module which is constructed to receive connection with a mobile communications network and thus produce a connection to the internet. It is therefore possible that the device can communicate concerning the life expectancy information over the internet. For example, the life expectancy information can be communicated to a maintenance company. The staff at the maintenance company then know that LED modules must soon be replaced.

The occurrence of such faults can be interrogated via BUS protocols of lighting technology (e.g. DALI, DMX, . . . ) and if applicable a group replacement can be initiated, without the lighting system previously failing or respectively no longer fulfilling its lighting task.

It would be possible for an engineer to verify the lighting status on site via corresponding maintenance tools (Servicebox, . . . ).

The problem named in the introduction is also solved according to the invention by an LED module having a printed circuit board, a plurality of LEDs soldered on the printed circuit board, and a device according to the present disclosure.

Preferably, the LED module includes a plurality of LEDs connected in series, e.g. at least 10 or 30 LEDs connected in series.

According to various embodiments, provision is made that the device is a plug device, which is suitable to be plugged onto an LED module and/or onto an electronic ballast. Advantageously, the device can be simply connected here to the positive and negative connection of the LED module. Therefore, it is particularly simple to retrofit a possibility for determining life expectancy information in existing LED modules and/or electronic ballasts. The plug device can have a temperature sensor, which is arranged on the plug device so that in the plugged state it faces the LED module, therefore can determine the temperature of the LED module.

According to various embodiments, provision is made here that the LED module has a constant current source for the supply of the LEDs with a constant current, wherein the constant current source is constructed to reduce the constant current when the device emits a first and/or a second alarm information.

This has the advantage that the LED module can be "conserved" when it is detected that an ageing of the LED module is already advanced so far that a failure of the LED module is impending. Through a reduction of the constant current, the output and therefore also the heat development of the LED module are reduced. Thereby, further thermal distortions can be at least partially prevented. The reduced output indeed involves a reduced lighting current for the user. In many cases, however, it will be preferred to have at least a certain minimum lighting instead of no lighting at all. In addition, the visibly reduced light current is an indication for the user that a certain ageing has already commenced in the LED module and therefore possibly a replacement soon of the LED module is necessary.

In various embodiments, the LED module can have first and second LEDs, wherein in a normal operation the first LEDs illuminate, the second LEDs, on the other hand, are switched off. The LED module can then be constructed, instead of a reduction of the constant current, to carry out a switching process, in order to switch over a supply current from the first LEDs to the second LEDs.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

Figure 1:
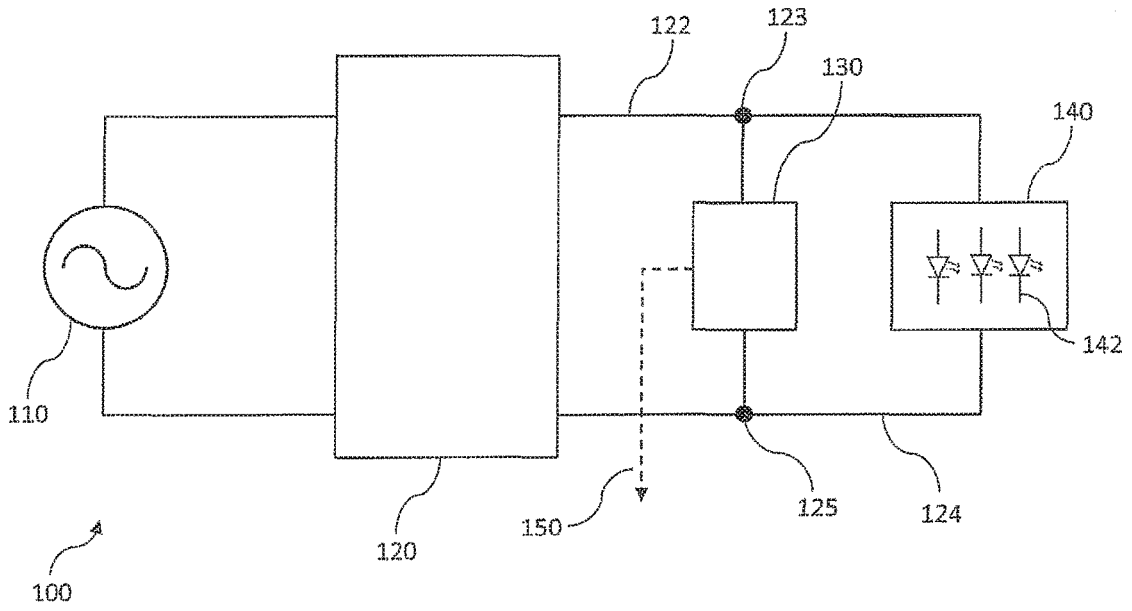
FIG. 1 shows an example simplified circuit diagram of an arrangement with a device according to the present disclosure and with an LED module.

FIG. 1 shows an example simplified circuit diagram 100 of an arrangement of AC voltage source 110, electronic ballast 120, device 130 and LED module 140. The electronic ballast 120 contains inter alia a rectifier, which converts the alternating voltage of the AC voltage source 110 into a direct-current voltage. The direct-current voltage is delivered via a positive feed 122 and a negative feed 124 to the LED module 140. At the positive feed 122 at a positive contact 123 a lead is diverted to the device 130. Likewise in the negative feed 124 at a negative contact 125 a negative lead is diverted to the device 130. The contacts 123, 125 can be realized e.g. by a plug connection, so that the device 130 can be added by simple plugging-on to an existing arrangement of electronic ballast 120 and LED module 140. At least some of the LEDs 142 of the LED module 140 are preferably connected in series (not illustrated in FIG. 1).

The device 130 has, furthermore, a bus connection 150, via which life expectancy information concerning the LED module 140, determined by the device, can be communicated to further electronic processing arrangements (not illustrated in FIG. 1).

Figure 2:
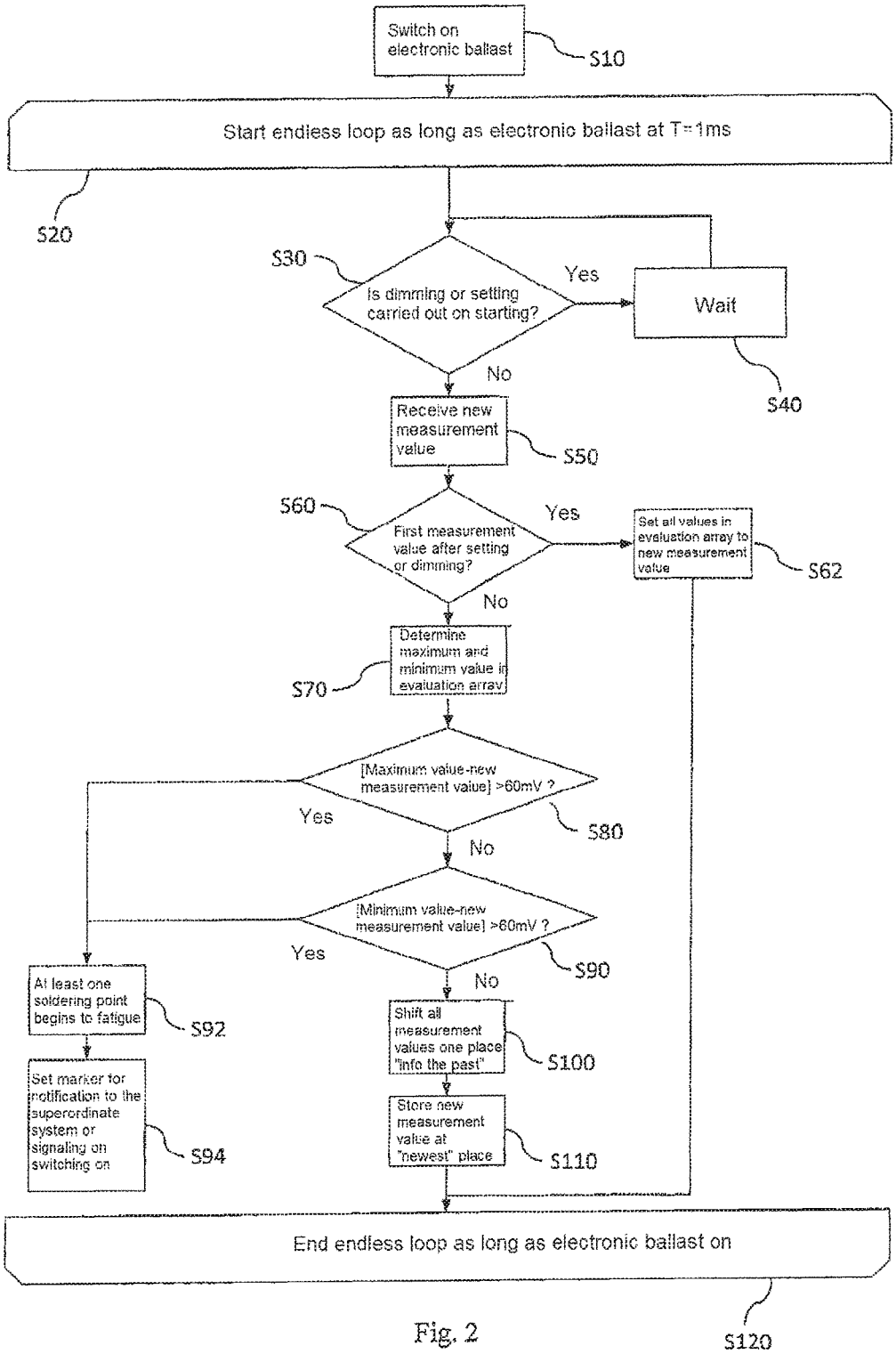
FIG. 2 shows a flow chart of a method according to the present disclosure for determining life expectancy information.

FIG. 2 shows a flow chart of a method according to the invention for determining life expectancy information.

In a first step S10 the LED module or respectively an electronic ballast is switched on. In a second step S20 the endless loop begins, in which the voltage jumps are detected. In the example illustrated here, the clock pulse is T=1 ms. In step S30 a check is made as to whether the LED module is currently dimmed or whether a settling phase is still present after the switching on of the LED module. In so far as this is the case, waiting is carried out in S40 and in the next clock pulse in step S30 a check is carried out again as to whether dimming is still occurring or whether a settling phase is still running.

As soon as it has been established in step S30 that dimming is no longer being carried out or settling is no longer being carried out, the method continues in step S50 and receives a new measurement value of a forward bias. In step S60 a check is then made as to whether this is the first measurement value after the dimming or settling. If yes, in step S62 all values are set to this new measurement value in an evaluation array serving as storage array. If no, the method continues in step S70 and the maximum value in the evaluation array (hereinbelow: maximum value) and the minimum value in the evaluation array (hereinbelow: minimum value) are determined.

In step S80 a check is made as to whether a difference between the maximum value and the new measurement value is greater than the minimum initial inverse voltage, 60 mV in the present example. If no, the method continues in step S90 and checks whether a difference between the minimum value and the new measurement value is greater than the minimum initial inverse voltage, here: 60 mV. If no, in step S100 all measurement values in the evaluation array are shifted one place "into the past" and in step S100 the new measurement value is stored at the "newest" place.

In alternative configurations of the invention, provision can be made that in step S70, instead of the determining of the maximum and minimum value, a time-averaged average value is determined. This can take place e.g. in that all forward biases that are stored in the evaluation array are averaged. In steps S80 and S90, a comparison can then take place with this time-averaged forward bias. For example, in step S80 it can be determined whether the current forward bias lies more than the (predetermined) positive minimum initial inverse voltage over the time-averaged forward bias and in step S90 it can be determined whether the current forward bias lies more than the (predetermined) negative minimum initial inverse voltage below the time-averaged forward bias. In these cases, in step S92 a fatigue of at least one soldering point can be detected.

In so far as one of the checks in step S100 or step S110 has produced a positive result that the minimum difference was therefore exceeded, in step S92 it is established internally that at least one soldering point is beginning to fatigue. In step S94 a marker is then set for a notification to the superordinate system or for a signalling on switching on. In the present example embodiment, the endless loop can be terminated here, in other embodiments, on the other hand, provision can be made that the endless loop is continued, e.g. in order to detect further life expectancy information and to emit it via a bus.

In step S120 the endless loop is terminated on switching off of the electronic ballast or respectively of the LED module.

Figure 3:
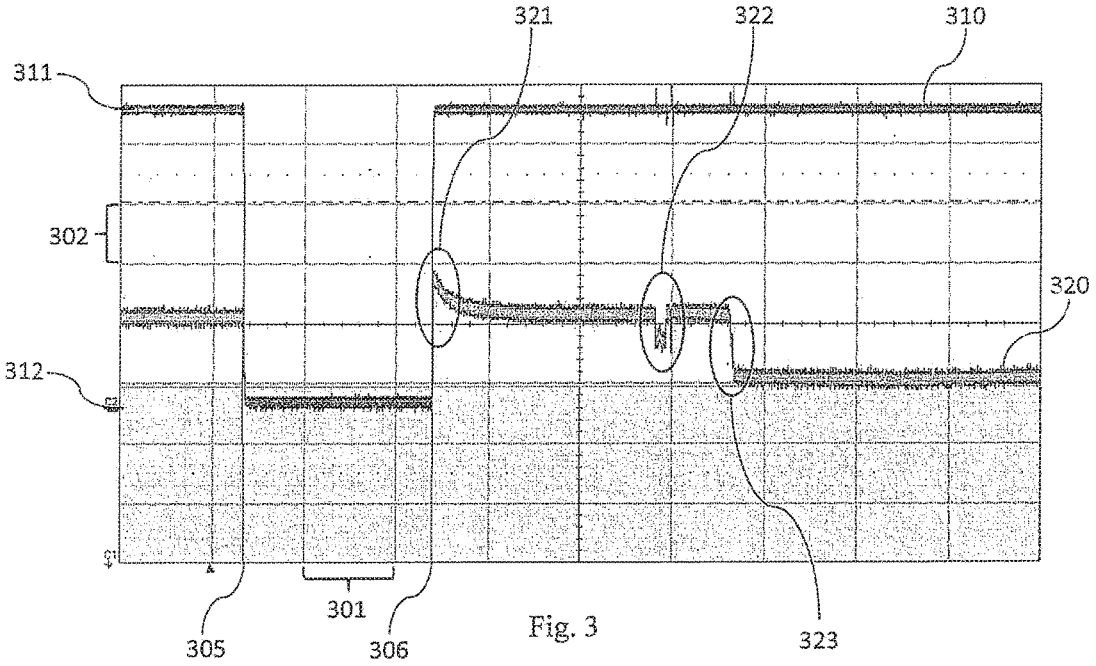
FIG. 3 shows a circuit diagram of forward bias and current in the connection to a switching off and on process of an LED module.
Figure 4:
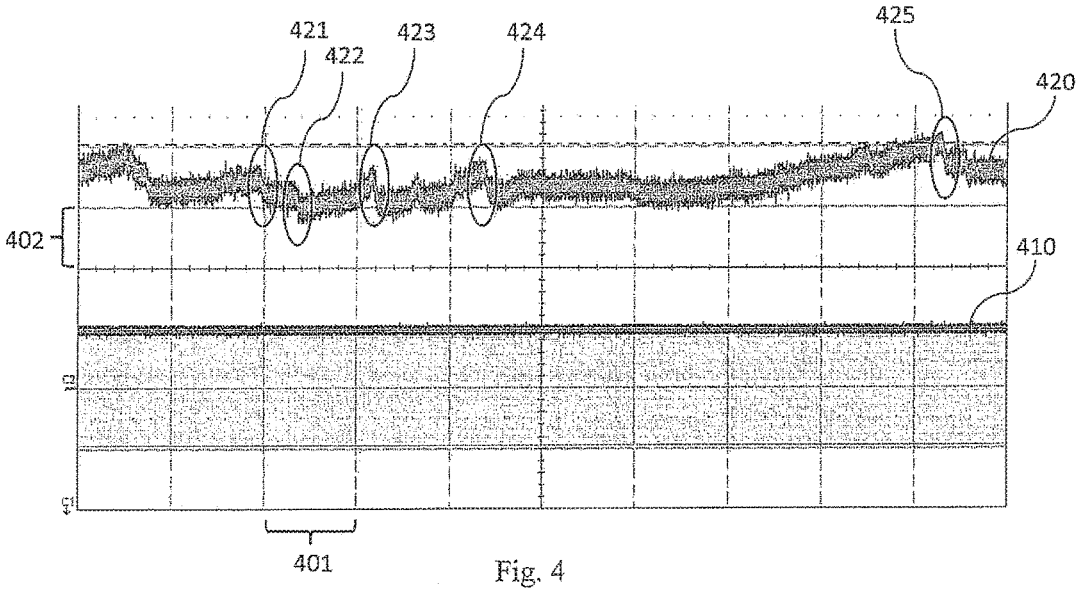
FIG. 4 shows a chart of forward bias in the current, wherein in the course of the forward bias several small voltage jumps can be detected.
Figure 5:
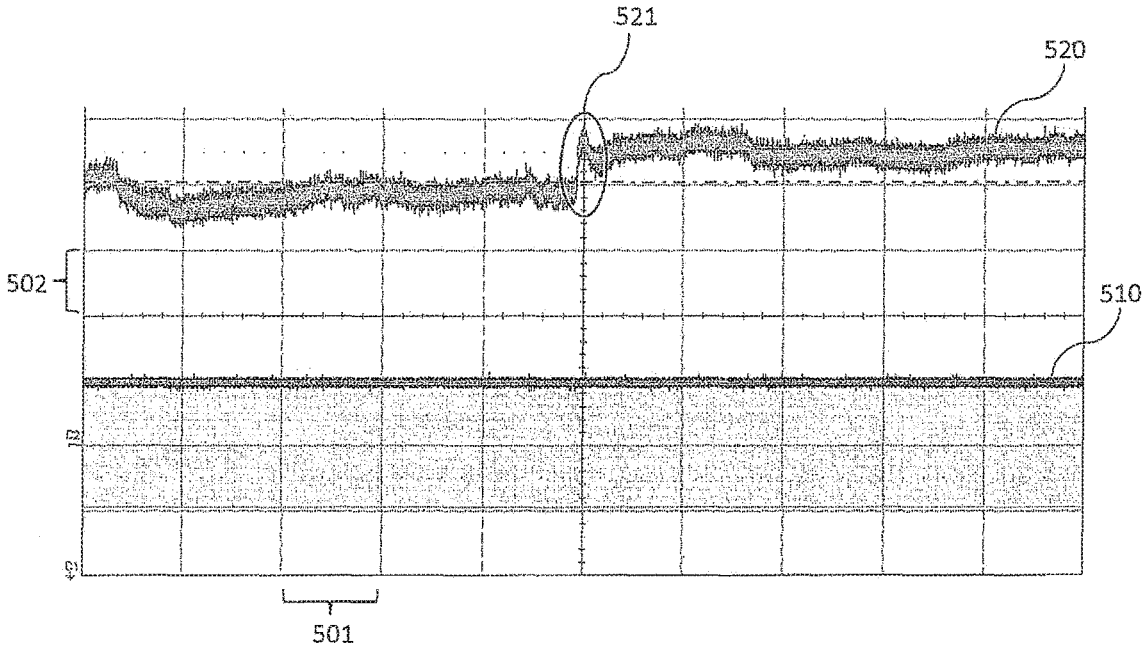
FIG. 5 shows a chart of forward bias and current, wherein in the course of the forward bias a large voltage jump can be detected.

FIGS. 3 to 5 show example developments of the forward bias and of the operating current of the LED module.

In the chart in FIG. 3, the horizontal axis represents the time, with a unit of 1 second per horizontal section 301. In vertical direction, the forward bias and operating current are entered, with units 2 V or respectively 100 mA per vertical section 302.

FIG. 3 relates to a scenario in which the LED module is first switched on, then switched off and switched on again. Accordingly, the operating current 310 firstly constant on the intended current value of the constant current source, marked by reference number 311 on the left axis, then at the time instant 305 of switching off suddenly drops to a zero current value, marked with reference number 312, and rises steeply again to the intended current value at the time instant 306 of switching on.

After the switching on at the time instant 306, a settling process 321 is to be observed in the voltage development 320, at which the voltage drops to stable voltage value within approximately 0.5 seconds. A first voltage fluctuation 322 has a voltage swing of barely 1 V. Depending on the selected embodiment of the invention, this can already be detected, or not, as a voltage jump. A second voltage fluctuation has a voltage swing of a good 2 V and would typically be detected as a voltage jump. After this voltage jump, the forward bias of the LED module swings to a new stable voltage value approximately 2 V lower.

In the charts in FIGS. 4 and 5, the horizontal axis represents the time, with a unit of 2 seconds per horizontal section 401, 501. In vertical direction, the forward bias and operating current are entered, with units 1 V or respectively 200 mA per vertical section 302.

FIG. 4 shows a scenario in which the LED module is switched on continuously. The operating current curve 410 is therefore substantially constant. The voltage curve 420 fluctuates continuously and has several voltage fluctuations 421, 422, 423, 424 and 425, which are detected by a method according to the invention as voltage jumps 421, 422, 423, 424 and 425. Depending on the setting of the minimum initial inverse voltage (which, as stated above, can depend e.g. on a detected temperature), further voltage fluctuations (not provided with reference numbers in FIG. 4) can also be detected as voltage jumps. On the other hand, a minimum initial inverse voltage which is too low can lead to noise also being misleadingly detected as a voltage jump.

In the scenario illustrated in FIG. 5, the LED module is likewise switched on during the entire represented time. The operating current curve 510 is therefore constant except for slight noise. Fluctuations are present in the voltage curve 520, in particular a voltage fluctuation 521 has a voltage swing of barely 2 V and is detected as voltage jump 521 by a method according to the invention.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. A method for determining life expectancy information of an LED module with a plurality of LEDs (142), the method comprising:

detecting of forward biases of the LED module at instants of time which lie less than 100 ms apart from each other, comparing a currently detected forward bias with one or more earlier detected forward biases, in order to detect a voltage jump which reaches a minimum initial inverse voltage within a predetermined jump duration, wherein the minimum initial inverse voltage is at least 60 mV and the predetermined jump duration is less than 100 ms long, and determining life expectancy information based on one or more detected voltage jumps.

2. The method according to claim 1, wherein the minimum initial inverse voltage is more than 200 mV and/or the jump duration is less than 50 ms long.

3. The method according to claim 1, wherein a negative minimum initial inverse voltage is defined for negative voltage jumps, at which the forward bias jumps to a lower value, and a positive minimum initial inverse voltage is defined for positive voltage jumps, at which the forward bias jumps to a higher value, wherein the positive minimum initial inverse voltage is different from the negative minimum initial inverse voltage.

4. The method according to claim 1, wherein the life expectancy information comprises:

a first alarm information, which is emitted when a voltage jump is detected for the first time, and/or a second alarm information, which is emitted when within a predetermined period of time, in particular within a predetermined period of time of the LED module in the switched-on state, more than one predetermined number of voltage jumps is detected.

5. The method according to claim 4, wherein the emitting of the first and/or second alarm information comprises emitting an acoustic and/or visual warning signal, in particular setting the LED module into a blinking mode.

6. The method according to claim 1, further comprising:

detecting a temperature and adapting the minimum initial inverse voltage and/or the predetermined jump duration based on the detected temperature.

7. The method according to claim 1, wherein after a switching on of the LED module firstly a predetermined settling time) is awaited, before the further method steps are carried out.

8. The method according to claim 1, further comprising:

storing of detected forward biases in a storage array, determining a minimum and/or a maximum forward bias stored in the storage array, wherein the comparing of a currently detected forward bias with one or more earlier detected forward biases comprises comparing the currently detected forward bias with the minimum and/or with the maximum forward bias.

9. The method according to claim 1, further comprising averaging several detected forward biases, in order to obtain a time-averaged forward bias, wherein the comparing of a currently detected forward bias with one or more earlier detected forward biases comprises comparing the currently detected forward bias with the time-averaged forward bias.

10. The method according to claim 1, wherein the life expectancy information comprises a likelihood of failure, wherein the likelihood of failure is determined based on an extent and/or a frequency of the voltage jumps, wherein the likelihood of failure is determined in particular proportional to the extent and/or frequency of the voltage jumps.

11. The method according to claim 10, further comprising determining a difference of the detected forward bias from a reference forward bias, wherein the likelihood of failure is determined proportional to the difference.

12. An LED module, comprising a printed circuit board, a plurality of LEDs soldered on the printed circuit board, and a device, wherein the LED module has a constant current source for supplying the LEDs with a constant current, wherein the constant current source is constructed to reduce the constant current when the device emits a first and/or a second alarm information the device being configured to carry out:

detecting of forward biases of the LED module at instants of time which lie less than 100 ms apart from each other, comparing a currently detected forward bias with one or more earlier detected forward biases, in order to detect a voltage jump which reaches a minimum initial inverse voltage within a predetermined jump duration, wherein the minimum initial inverse voltage is at least 60 mV and the predetermined jump duration is less than 100 ms long, and determining life expectancy information based on one or more detected voltage jumps.

* * * * *